United States Patent [19]

Sherwood et al.

[11] 4,394,809

[45] Jul. 26, 1983

[54] CORELESS HUNG PANEL ASSEMBLY

[75] Inventors: Edward F. Sherwood, Gettysburg; Karl B. Orndorff, Bonneauville Boro, both of Pa.

[73] Assignee: Westinghouse Electric Corp., Pittsburgh, Pa.

[21] Appl. No.: 269,136

[22] Filed: Jun. 1, 1981

[51] Int. Cl.[3] ..... E04C 2/08

[52] U.S. Cl. ..... 52/512; 52/269; 52/511; 52/827; 52/828

[58] Field of Search ..... 52/506, 508, 510, 509, 52/813, 821, 827, 828, 269, 512, 511

[56] References Cited

U.S. PATENT DOCUMENTS

| | | | |
|---|---|---|---|
| 837,014 | 11/1906 | Wege | 52/827 |
| 2,193,207 | 3/1940 | Rosen | 52/506 |
| 2,260,590 | 10/1941 | Speck | 52/828 X |
| 2,317,015 | 4/1943 | Allen | 52/547 X |
| 2,395,726 | 2/1946 | Del Tufo | 52/509 |
| 2,862,585 | 12/1958 | McChesney | 52/508 |
| 3,103,708 | 9/1963 | Pomeroy et al. | 52/269 X |
| 3,160,974 | 12/1964 | Carleton | 52/828 X |
| 3,282,004 | 11/1966 | Brounn | 52/509 |
| 3,312,027 | 4/1967 | Lawer | 52/511 X |
| 3,740,916 | 6/1973 | Kenaga | 52/629 |
| 3,838,245 | 9/1974 | Jecmen et al. | 52/828 X |
| 3,976,269 | 8/1976 | Gupta | 244/119 |
| 4,204,665 | 5/1980 | Sherwood | 256/65 |

*Primary Examiner*—Alfred C. Perham
*Assistant Examiner*—David J. Thomas
*Attorney, Agent, or Firm*—D. R. Lackey

[57] ABSTRACT

A coreless, fireproof, hung panel assembly which includes a metallic sheet panel member having first and second major sides, stiffened by a plurality of metallic rib members on the second side. A plurality of metallic support members on a wall cooperate with certain of the metallic rib members, such that that panel member is securely and tightly held against the wall. The first side includes a decorative film, or laminate, suitably fixed thereto.

2 Claims, 5 Drawing Figures

CORELESS HUNG PANEL ASSEMBLY

BACKGROUND OF THE INVENTION

1. Field of the Invention

The invention relates in general to new and improved panel member assemblies, and more specifically to decorative panel member assemblies which are hung on a wall.

2. Description of the Prior Art

Panel members are often hung on a wall to provide a desired decorative effect. For example, decorative panels are often hung on the walls of steel elevator cabs to provide an attractive, finished appearance.

In the prior art, such panel members usually include two spaced major outer surfaces, both of which may be finished. These decorative surfaces or veneer laminates are disposed against and supported by a wooden frame and a wood, or a honeycomb paper, core. In addition to being quite heavy, the frame and core are flammable. In certain applications for hung panels, such as elevators, it is desirable to reduce the weight of the cab, and it is also desirable to reduce or eliminate the amount of flammable material. Thus, it would be desirable to provide new and improved hung panel assemblies which are lighter than those of the prior art, and at the same time, use little or no flammable material in their construction.

However, these objectives should not be achieved to the detriment of certain other desirable features. For example, it is important that the panel members be easily and quickly mounted on the associated wall by a single installer, and just as easily removed by authorized personnel. It is also important that the mounting arrangement be concealed from view, for aesthetic reasons, and to discourage tampering. Finally, the panel mounting arrangement must securely and tightly mount the panel against the associated wall, and the tightness must be maintained such that no vibration develops during usage, even when the panel members are used in an elevator cab and subjected to the accelerating and decelerating forces associated therewith.

SUMMARY OF THE INVENTION

Briefly, the present invention is a new and improved coreless, fireproof hung panel assembly which is constructed of metallic sheet material having metallic ribs fixed to one side thereof. The other side supports a decorative film, or decorative laminate, as desired. The support arrangement includes resilient cam clips on the wall, and elongated slots or openings in certain of the rib members. The cam clips resiliently bias the panel assembly firmly against the wall, without overstressing the clips, due to the cam angle which is selected to transfer the major portion of the panel weight into a horizontal component which forces the panel tightly against the wall.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
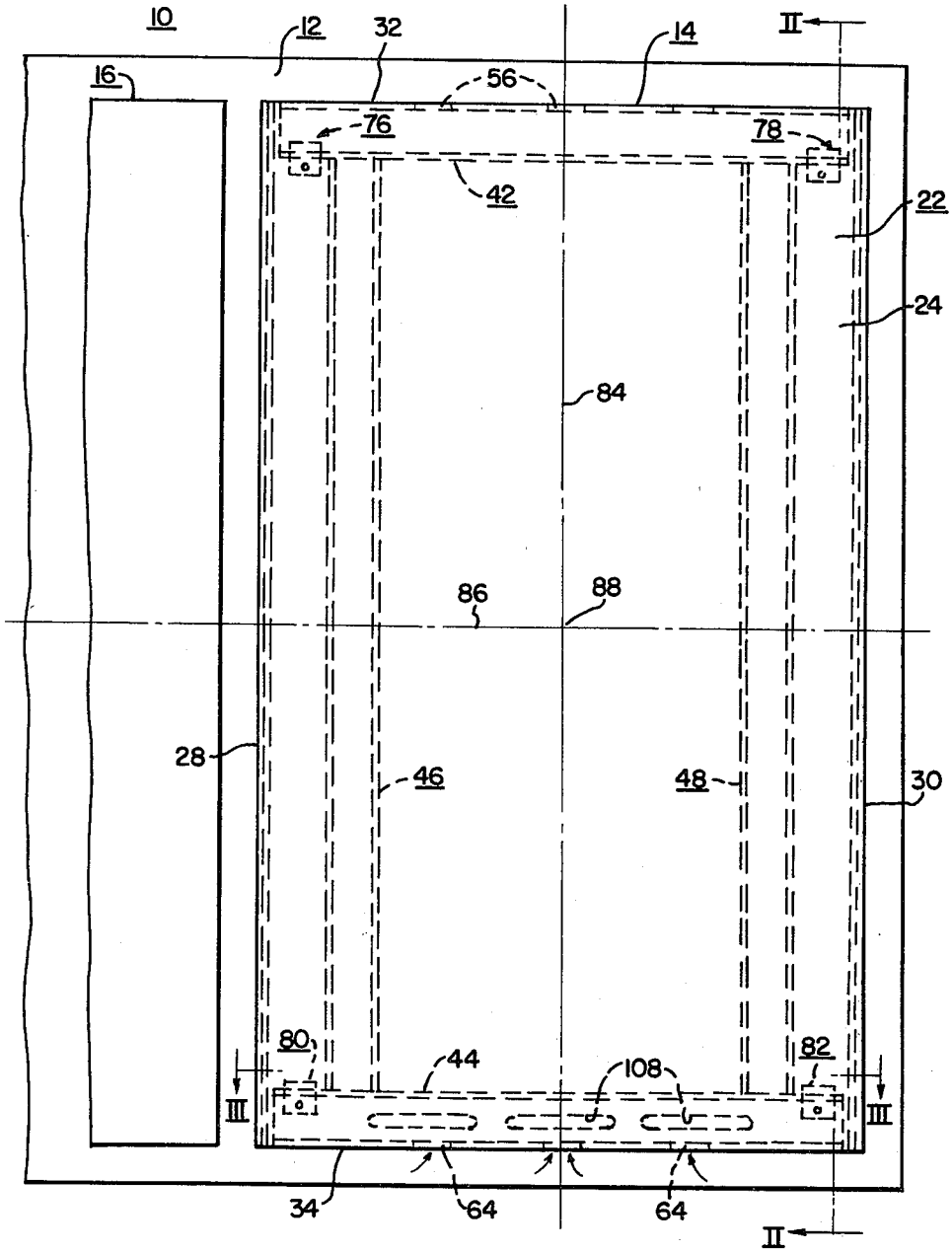
FIG. 1 is an elevational view of a wall having decorative panels hung thereon according to the teachings of the invention.

Referring now to the drawings, and to FIG. 1 in particular, there is shown a new and improved coreless, fireproof hung panel assembly 10 constructed according to the teachings of the invention. Assembly 10 includes a wall 12, such as a steel wall of an elevator cab, upon which one or more panel assemblies are mounted or hung, such as panel assemblies 14 and 16. Wall 12, best shown in the cross-sectional views of FIGS. 2 and 3, has first and second major opposed surfaces 18 and 20, with surface 18 being a front surface upon which the panel assemblies 14 and 16 are mounted.

Figure 2:
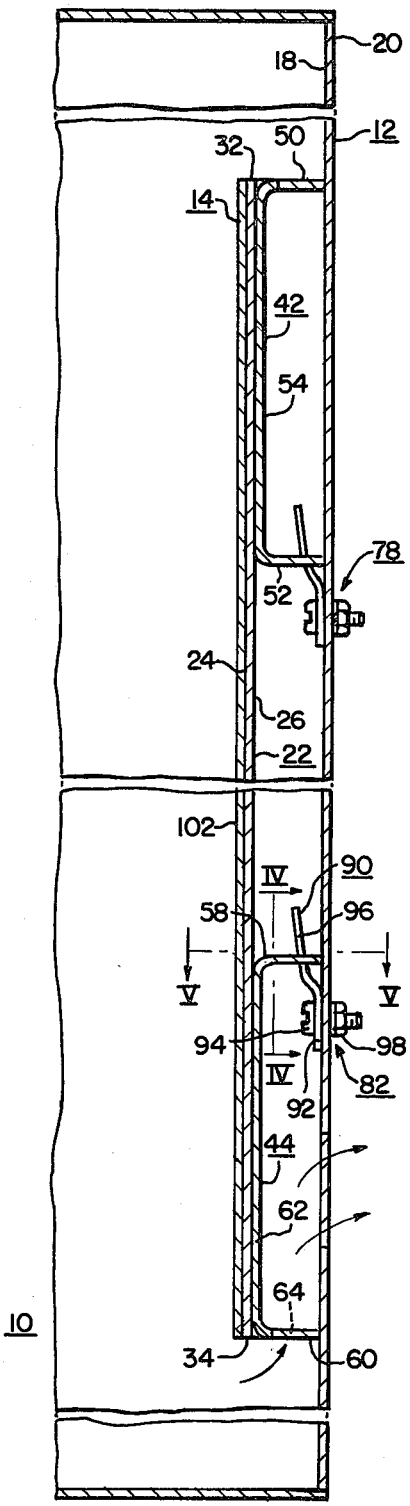
FIG. 2 is a side elevational view, in section, of the panel assembly shown in FIG. 1, taken between and in the direction of arrows II—II.
Figure 3:
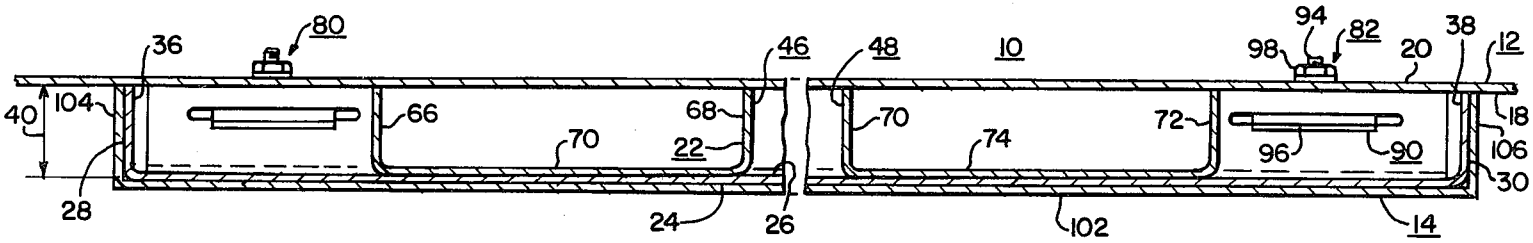
FIG. 3 is a plan view of the panel assembly shown in FIG. 1, taken between and in the direction of arrows III—III.

Since panel assemblies 14 and 16 are of like construction, only panel assembly 14 will be described in detail. FIGS. 1, 2 and 3 will all be referred to during the subsequent discussion of panel assembly 14, with FIG. 2 being an elevational view, in section, of panel assembly 14 shown in FIG. 1, taken between and in the direction of arrows II—II, and with FIG. 3 being a plan view, in section, of panel assembly 14 shown in FIG. 1, taken between and in the direction of arrows III—III.

More specifically, panel assembly 14 includes a large metallic sheet member 22, such as 0.048 inch thick steel, having first and second flat, major, parallel, opposed sides or surfaces 24 and 26, respectively. Sheet member 22 includes first and second lateral edges or side portions 28 and 30, respectively, and top and bottom edges 32 and 34, respectively. In a preferred embodiment of the invention, the first and second side edges 28 and 30 are defined by integral flanges 36 and 38, respectively, which extend perpendicularly outward from the second side 26 for a dimension 40. Flanges 36 and 38 add stiffness to the sheet member 22, and they give the panel assembly the desired depth necessary to simulate a core-type panel of the prior art. The flanges 36 and 38 also provide support for a decorative film or a decorative laminate, as will be hereinafter explained.

Additional panel stiffness is provided by first, second, third and fourth rib members 42, 44, 46 and 48, respectively. The rib members are preferably in the form of elongated metallic steel channel members having first and second parallel leg portions spaced by about 2.5 inches, for example, joined by a connecting bight or back portion, as will be hereinafter described in detail. The leg portions are dimensioned such that their ends are aligned in a common plane with the ends of flanges 36 and 38.

More specifically, the first rib member 42, as best shown in FIG. 2, has first and second leg portions 50 and 52, respectively, and a bight 54. Bight 54 is spot welded to surface 22 such that member 42 is horizontally oriented, with its first leg portion 50 extending perpendicularly outward from the top edge 32 to provide a horizontally oriented top side of the panel assembly 14. A plurality of notches or openings 56 may be formed in the first leg portion 50, for purposes which will be hereinafter explained. Elongated slots or openings are formed in the second leg portion 52 for cooperation with fastener means, as will be hereinafter shown and described in detail. The length of the first rib member 42 in the direction of its longitudinal axis is selected such that it fits snugly, without interference, between the flanges 36 and 38.

In like manner, the second rib member 44, also best shown in FIG. 2, has first and second leg portions 58 and 60, respectively, and a bight 62. Bight 62 is spot welded to surface 22 such that member 44 is horizontally oriented, with its second leg portion 60 extending perpendicularly outward from the bottom edge 34 to provide a horizontally oriented bottom side portion of the panel assembly 14. A plurality of notches or openings 64 may be formed in the second leg portion 60, for purposes which will be hereinafter explained. Elongated slots or openings are formed in the first leg portion 58 for cooperation with fastener means, as will be hereinafter shown and described in detail. The length of the second rib member 44, in the direction of its longitudinal axis, is selected such that it fits snugly, without interference, between flanges 36 and 38.

The third rib member 46, best shown in FIG. 3, includes first and second leg portions 66 and 68, respectively, and a bight 70. Bight 70 is spot welded to surface 22 such that member 46 is vertically oriented, with its first leg portion 66 in predetermined spaced, parallel relation with flange 36. Member 46 has a length, in the direction of its longitudinal axis, selected such that it closely fits, without interference, between the first and second horizontally oriented rib members 42 and 44, respectively.

The fourth rib member 48, also best shown in FIG. 3, includes first and second leg portions 71 and 72, respectively, and a bight 74. Bight 74 is spot welded to surface 22 such that member 48 is vertically oriented, with its second leg portion 72 in predetermined spaced parallel relation with flange 38. Member 48 has a length dimension, in the direction of its longitudinal axis, selected such that it closely fits, without interference between the first and second horizontally oriented rib members 42 and 44, respectively.

Additional vertically oriented rib members may be utilized, as required, depending upon the width dimension of the panel.

First, second, third and fourth like constructed support assemblies 76, 78, 80 and 82, respectively, are disposed adjacent to the four right angle outer corners of the rectangularly configured panel assembly 14, symmetrically arranged relative to vertical and horizontal panel center lines 84 and 86, respectively. The symmetrical locations, plus the construction of the support assemblies, to be hereinafter described, enables the panel assembly 14 to be hung on wall 12 in the orientation shown, or it may be rotated 180° about axis 88 at the intersection of center lines 84 and 86, and hung "upside down". Since panel assembly 14 has only one decorative surface, it is desirable to provide this feature of being able to mount panel assembly 14 in two different orientations, each in 180 degree rotational symmetry with the other. Thus, eye level marks on the panel's decorative surface may be rotated to a lower, less conspicuous location.

Figure 5:
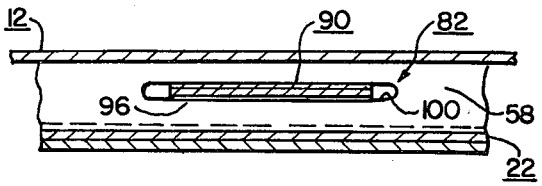
FIG. 5 is a plan view of the panel support arrangement shown in FIG. 4, taken between and in the direction of arrows V—V in FIG. 2.
Figure 4:
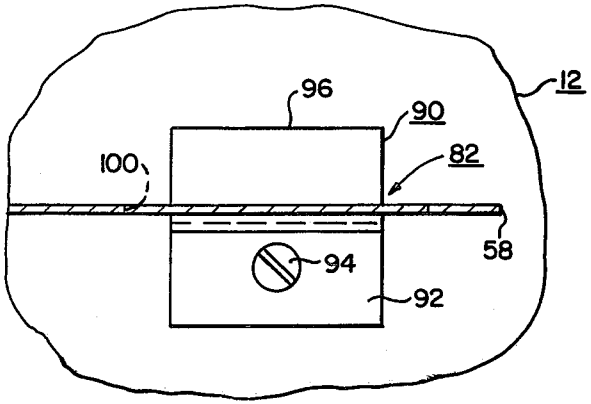
FIG. 4 is an elevational view of a panel support arrangement shown in FIGS. 1, 2 and 3, taken between and in the direction of arrows IV—IV in FIG. 2.

Since the support assemblies are of like construction, only support assembly 82 will be described in detail. FIGS. 4 and 5 are elevational and plan views of support assembly 82, respectively, taken between and in the direction of arrows IV—IV, and arrows V—V, respectively, in FIG. 2.

More specifically, support assembly 82 includes a cam clip 90 having a first portion 92 which includes an opening for receiving a suitable fastener, such as the pan head screw 94 illustrated, and a second portion 96, which is an integral extension of the first portion 92, with the second portion being bent outwardly from the plane of the first portion by a predetermined small angle, such as about 8°–10°. Clip 90 is formed of a material selected such that the second portion of the clip may be flexed outwardly by a predetermined small angle, without losing its spring back or resiliency. For example, the clip may be constructed of spring steel. A suitably located opening is formed in cab wall 12, and the clip 90 is fastened to wall 12 via the screw 94 and the nut 98, with the second portion 96 of the clip 90 extending vertically upward from the first portion 92.

As hereinbefore stated, the second leg portion 52 of the first horizontally oriented rib member 42 has elongated slots or openings for cooperating with fastener assemblies 76 and 78, and the first leg portion 58 of the second horizontally oriented rib member 44 has elongated slots or openings for cooperating with the fastener assemblies 80 and 82. Accordingly, a slot 100 is formed in leg portion 58 for receiving the second portion 96 of the cam clip 90.

The angle of the second portion 96 relative to a vertically oriented plane, and the location of slot 100 relative to the end of leg portion 58, are selected such that their cooperation during assembly of panel member 14 with the support assemblies will cam the panel assembly inwardly toward wall 12 along the inclined portions of the clips. As the panel is cammed inwardly, the ends of the leg portions, such as leg portions 52 and 58, will contact wall 12, and at this point, the second portion 96 will be flexed outwardly from its normal orientation, but by only a small flexural angle, such as 2°–3° from the normal position. This arrangement assures a continuous inward bias or urging of the panel assembly 14 against wall 12, as the weight supported by each angled clip is divided into a horizontal component and into a vertical component. The horizontal component forces the panel member 14 tightly against the wall 12. Since this cam action of inwardly urging the panel member occurs at all four of its corners, the flatness of the panel member is assured.

The metallic sheet member 22 may have a decorative film on its first major surface 24, such as paint, it may have a decorative, polished metal wire screen suitably attached thereto, or, as illustrated, it may have a suitable fire resistant or fireproof decorative laminant glued thereto, such as laminate 102 fixed to the first major surface 24 with a suitable contact glue. Also, laminates 104 and 106 may be fixed to flanges 36 and 38, respectively, with the same contact glue. The laminate may be metallic, such as a thin sheet of stainless steel, or nonmetallic, such as a decorative plastic material selected for its resistance to flame.

The wall 12 may have one or more ventilation openings 108 formed therein which are concealed behind the panel assemblies. Openings 56 or 64 in leg portions 50 and 60, respectively, will be in air flow communication with openings 108, depending upon the orientation of the panel assembly.

A typical panel assembly of the prior art having a wood frame, a height dimension of 81.5 inches, and a width dimension of 30 inches, weights about 60 pounds. A like dimensioned panel constructed according to the teachings of the invention weighs 48 pounds painted, 49 pounds with a thin sheet of stainless, 51.25 pounds with a 0.038 inch thick plastic lamination, and 54 pounds with a 0.060 inch thick plastic lamination. Thus, a substantial weight savings is achieved by the disclosed hung panel assembly, while achieving the other objectives of eliminating flammable materials, providing an easily installed and easily removed panel assembly, and providing a panel assembly which is pleasing to the eye.

To install the panel assembly 14, it is only necessary to lift the assembly slightly higher than its desired location on the wall. The panel assembly is then lowered to cause the cam clips to enter the cooperative slots in the rib members of the panel. The weight of the panel assembly will then cause the panel assembly to be cammed tightly into the desired position. A small out-of-sight screw may be inserted flush with the top edge defined by leg portion 50, to prevent unauthorized lifting of the panel assembly. Authorized personnel, however, may remove this screw and easily lift and remove the panel assembly for panel maintenance, replacement, or 180° reversal of orientation.

We claim as our invention:

1. A coreless, fireproof, hung panel assembly including a panel member which is disposed against, and which extends outwardly from, a wall surface, comprising:

a metallic panel member having top and bottom edges, first and second side edges, first and second major, parallel opposed sides, and first, second, third and fourth outer corners;

a plurality of metallic rib members fixed to, and extending outwardly from, the second major side of said panel member to stiffen as well as give depth to the resulting panel assembly said plurality of rib members including first and second horizontally oriented, elongated channel members, each of which have first and second leg portions and a connecting bight portion, with their bight portions being fixed to the second major side such that said first and second channel members extend horizontally across the second side, immediately adjacent to the top and bottom edges, respectively, of the panel member, said first and second leg portions of the first and second horizontally oriented channel members extending outwardly by a predetermined dimension to function as top and bottom edges, respectively, of the resulting panel assembly;

a wall defining a flat surface;

and at least first, second, third and fourth support members of like construction fixed to said wall, each of said support members including an upstanding metallic tab portion which angles outwardly at a predetermined small angle from said wall;

said second leg portion of the first channel member having first and second elongated openings adjacent to the first and second outer corners, respectively, of the metallic panel member;

said first leg portion of the second channel member having first and second elongated openings adjacent to the third and fourth outer corners, respectively, of the metallic panel member;

said elongated openings being spaced inwardly by a predetermined dimension from the extreme ends of their associated outwardly extending leg portions;

said metallic tab portions of the first and second support members extending through the first and second elongated openings of the first channel member, and said metallic tab portions of the third and fourth support members extending through the first and second elongated openings of the second channel member;

wherein the predetermined dimension of the first and second leg portions of the first and second channel members, respectively, the predetermined angle between the tab portions and said wall, and the predetermined spacing between the elongated openings in the first and second channel members and the ends of their associated leg portions, are all selected such that said tab portions are flexed slightly outward by the weight of the resulting panel assembly when the ends of at least the first and second leg portions of the first and second channel members are cammed tightly against the wall surface via the angled metallic tab portions, to resiliently force the first, second, third and fourth corners of the metallic panel member tightly against said wall surface to assure flatness of said panel member.

2. The hung panel assembly of claim 1 wherein the plurality of support members, and the rib members which cooperate therewith, are constructed and symmetrically located such that the resulting panel assembly may be hung in a first orientation, and in a second orientation which is in 180° rotational symmetry with the first orientation.

* * * * *